US006062357A

United States Patent [19]

Bogert

[11] Patent Number: 6,062,357

[45] Date of Patent: May 16, 2000

[54] WHEELED CARRYING BAG

[75] Inventor: Christina Bogert, Crawford, N.J.

[73] Assignee: Monarch Luggage Company, Inc., New York, N.Y.

[21] Appl. No.: 09/103,282

[22] Filed: Jun. 23, 1998

[51] Int. Cl.[7] ..... A45C 5/14; A45C 13/26; A45C 13/36

[52] U.S. Cl. ..... 190/18 A; 190/39; 190/115; 190/127; 206/320

[58] Field of Search ..... 190/18 A, 30, 190/115, 127; 280/DIG. 3; 206/320

[56] References Cited

U.S. PATENT DOCUMENTS

| | | | |
|---|---|---|---|
| 4,354,583 | 10/1982 | Walker | 190/18 A |
| 5,431,262 | 7/1995 | Rekuc et al. | 190/18 A |
| 5,431,428 | 7/1995 | Marchwiak et al. | 190/18 A X |
| 5,456,342 | 10/1995 | Rekuc et al. | 190/18 A |
| 5,494,157 | 2/1996 | Golenz et al. | 206/320 |
| 5,566,797 | 10/1996 | Van Himbeeck | 190/18 A |
| 5,653,319 | 8/1997 | Wang | 190/18 A X |
| 5,676,286 | 10/1997 | Song | 190/18 A X |
| 5,743,363 | 4/1998 | Rekuc et al. | 190/18 A |
| 5,749,503 | 5/1998 | Wulf et al. | 190/18 A X |
| 5,782,325 | 7/1998 | O'Shea et al. | 190/18 A |
| 5,806,638 | 9/1998 | Mao | 190/18 A X |

FOREIGN PATENT DOCUMENTS

| | | | |
|---|---|---|---|
| 1563534 | 4/1969 | France | 190/18 A |
| 2359229 | 6/1975 | Germany | 190/18 A |

*Primary Examiner*—Sue A. Weaver
*Attorney, Agent, or Firm*—Stroock & Stroock & Lavan LLP

[57] ABSTRACT

A wheeled carrying bag includes a soft front panel, a soft back panel, a soft side panel and a bottom which are attached to each other. The bag has two wells located within the bag, one of which is capable of carrying a laptop computer. The bag has a top with a regular carrying handle and an adjustable wheeling handle. The adjustable handle is attached to the bag with the help of supports which are disposed within the bag. The bag has a bottom with wheels attached to the bottom.

20 Claims, 5 Drawing Sheets

WHEELED CARRYING BAG

BACKGROUND OF THE INVENTION

The present invention relates generally to a wheeled carrying bag and, in particular, to a wheeled carrying bag capable of carrying a laptop computer.

Small wheeled carrying bags are well known in the art and have become quite popular. The most popular type of small wheeled carrying bags are square rigid pieces with a retractable handle on the top and wheels on the bottom to enable the weight of the bags to be carried on the wheels rather than on the arms or shoulders of the bearer. A heavy reinforcing board is placed on the bottom panel of the bag. Generally, the handle is attached directly to the bottom board or additionally to the rigid side panel of the carrying bag. The handle extends to a convenient reach when in use and retracts out of the way when not in use.

While the prior art wheeled carrying bags work for their intended purpose, a significant drawback to these prior art wheeled carrying bags is that, due to the materials used in the rigid hard frames of the bags and the required attaching board, the bags tend to be relatively heavy. This does not pose a problem when the bag is being wheeled by the user. However, when the carrying bag is used in a non-wheeled position and physically carried by the user, the rigid hard frame of the carrying bag adds to the weight of the bag making it bulkier and heavier, thereby tiring the arm of the user and defeating the purpose of having a wheeled carrying bag.

Often the decision to buy a small wheeled carrying bag is made based on the weight and outer texture of the bag. Therefore, these heavy prior art bags provide disincentives to be purchased.

The prior art wheeled carrying bags generally have the wheels on the bottom of the bag spaced at a distance that is less than or equal to the length of the bag's bottom panel. This results in a relatively unstable bag when the bag is in its wheeled position and supported by the wheels, providing a further disincentive to purchase.

Moreover, when the adjustable handles of the prior art wheeled carrying bags are in the retracted, non-wheeled position, the handle grip rests in a rigid, non-pliable frame housing which adds to the weight of the bag and generally protrudes out from the side of the bag. This protruding frame tends to get in the way when the carrying bag is being carried in the user's hand. Moreover, the protruding frame also detracts from the aesthetics of the bag, providing a further disincentive to purchase.

Accordingly, it is desirable to provide a small wheeled carrying bag that is made of a soft pliable material, is of light weight, has a more stable wheeling structure, a lighter handle assembly, and uses molded pliable frames which are flush with the body of the bag.

SUMMARY OF THE INVENTION

Generally speaking, in accordance with the present invention, a wheeled carrying bag has a soft front panel, a soft back panel, a soft side panel and a bottom panel attached to each other. The wheeled carrying bag has an adjustable wheeling handle mounted on the back panel and at least two wheels attached to the bottom. The distance between the wheels is greater than the length of the bottom.

The bottom of the bag may also include a molded base and a molded bottom stand which adds to the stability of the bag when it is resting on the wheels in an upright position.

The wheeled carrying bag also has two wells within the bag which are separated by a divider panel. One of these wells contains supports for attachment of the adjustable handle to the bag.

In a preferred embodiment, one of these wells is adapted to contain a laptop computer. In another preferred embodiment, the wheeled carrying bag has zippered outer pockets, zippers connecting the front panel and the side panel, a covering flap for the side panels and a carrying handle for carrying the bag in a non-wheeled manner.

Accordingly, it is an object of the present invention to provide an improved soft wheeled carrying bag.

Another object of the present invention is to provide a soft wheeled carrying bag with an adjustable handle which rests in a pliable, molded frame which is flush with the body of the bag.

Yet another object of the present invention is to provide a wheeled carrying bags with wheels that result in a more stable wheeled carrying bag.

Still another object of the present invention is to provide for the attachment of the adjustable handle to the soft back panel of the wheeled carrying bag that results in a lighter bag and maintains the soft, flexible nature of the carrying bag.

A further object of the present invention is to provide for a wheeled carrying bag adapted to contain a laptop computer.

Still other objects and advantages of the invention will in part be obvious and will in part be apparent from the specification and the drawings.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
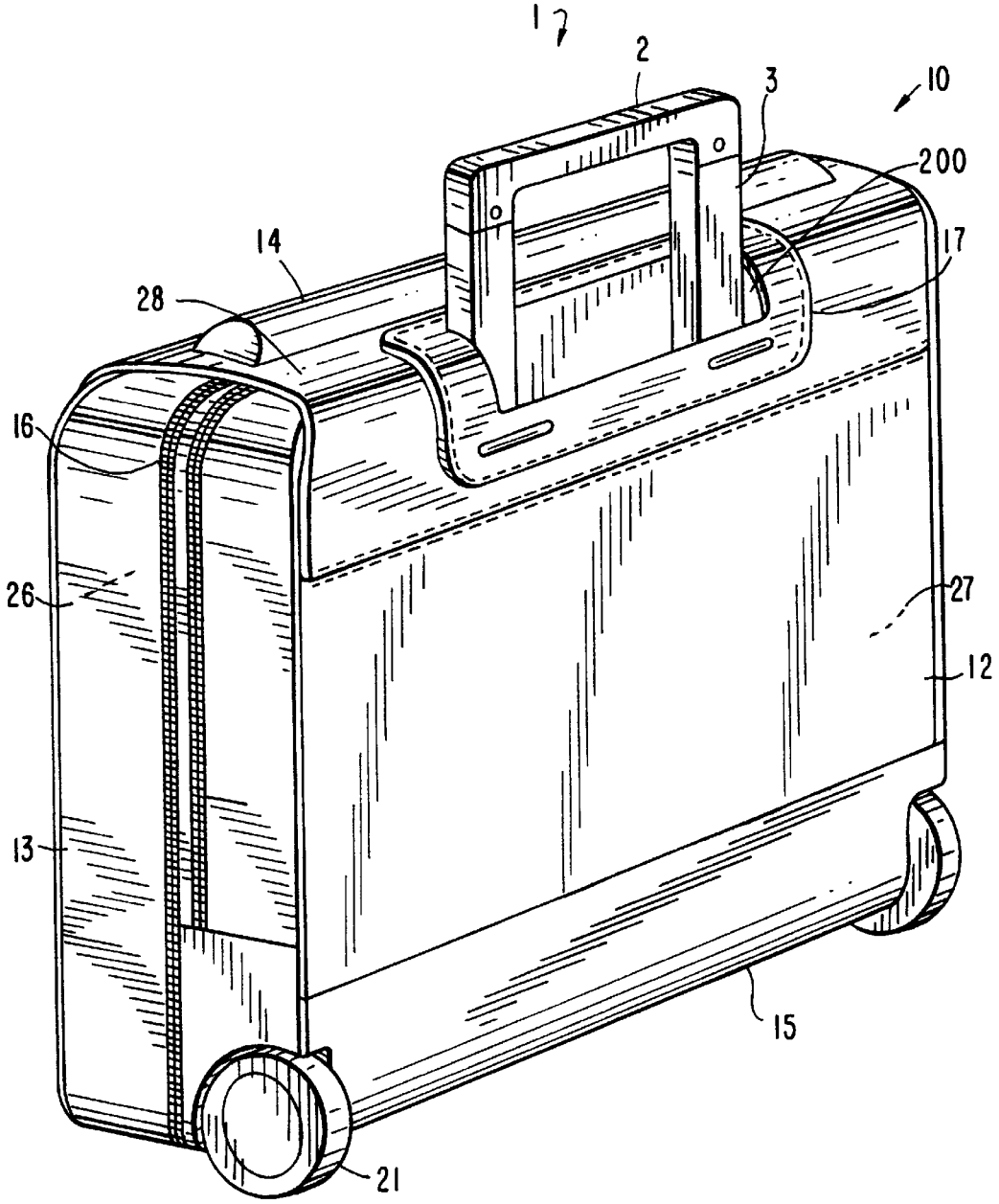
FIG. 1 is a rear perspective view of the wheeled carrying bag constructed in accordance with the invention.
Figure 2:
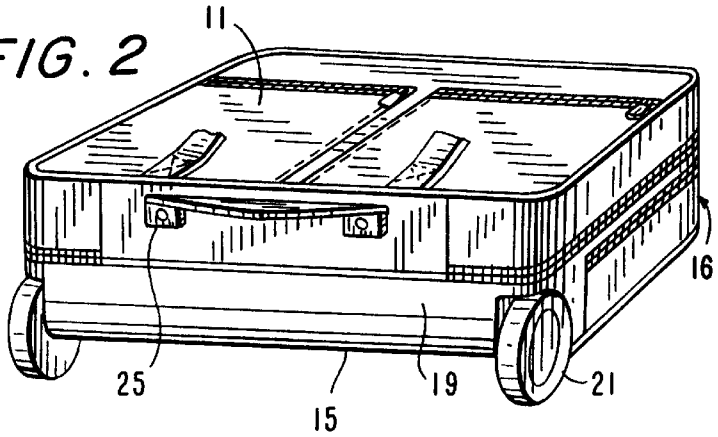
FIG. 2 is a bottom perspective view of the wheeled carrying bag constructed in accordance with the invention.

Reference is first made to FIGS. 1 and 2 which illustrate a small wheeled carrying bag generally indicated as 10, constructed in accordance with a first embodiment of the invention. Wheeled carrying bag 10 includes a soft front panel 11, and a soft back panel 12, which is attached to front panel 11 by a bottom panel 15. Carrying bag 10 also includes a soft side panel 13, which is attached to front panel 11 and back panel 12. Side panel 13 extends around three sides of carrying bag 10 and has an opening which also extends across three sides of side panel 13 and is selectively closed by a zipper 16, or the like, to provide access to the interior of carrying bag 10. Wheels 21 are mounted to bottom 15. A handle assembly 1 is disposed within bag 10. Handle assembly 1 includes a grip 2 and handle rods 3. Handle rods 3 extend through back panel 12.

Wheeled carrying bag 10 may also include a covering flap 28 affixed at one end to back panel 12 and movable about its affixed end between a first position in which flap 28 extends over side panel 13 and at least a portion of front panel 11, and a second position in which front panel 11 and side panel 13 are exposed. Covering flap 28 is capable of being affixed at the opposite end to front panel 11 by hooks, clips, buttons and the like. In a preferred embodiment, carrying flap 28 may have an opening 200 formed therein to allow handle rods 3 to pass therethrough.

A molded pliable base 19 is affixed to the bottom 15 of carrying bag 10. Molded base 19 may have a molded bottom stand 25 attached to it. Base 19 has two wheels 21 attached thereto; one wheel 21 attached on each side of base 19. The distance between wheels 21 is such that it is greater than the length of bottom 15.

Figure 7:
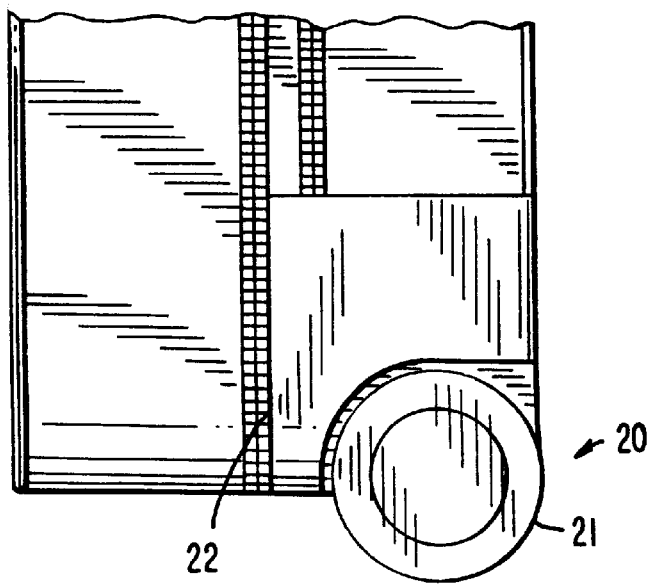
FIG. 7 is a side elevational view of the wheel assembly constructed in accordance with the invention.

Reference is now made to FIG. 7 which shows a wheel assembly generally indicated as 20. Each wheel assembly 20 includes a wheel 21 and may include a molded, pliable wheel cover 22. Wheels 21 are connected to wheel cover 22 by a shaft as known in the art. Wheel cover 20 is then mounted to a corner of bag 10.

FIGS. 1 and 2 show two wheels 21 attached to bottom 15 of carrying bag 10. Wheels 21 are attached to bottom 15 at the junction of back panel 12 and side panel 13 so that one wheel 21 is attached on each side of bottom 15. The axis of wheels 21 are coaxial and preferably affixed so that the wheeled carrying bag will trail in a straight line behind the user when carrying bag 10 is used in a wheeled position as described below. Wheeled carrying bag 10 may contain two or more wheel assemblies 20. At a minimum, wheeled carrying bag 10 includes one wheel assembly on each side of bottom 15. By spreading wheels 21 by a distance greater than the length of bottom 15, a greater stability during wheeling is provided as well as greater stability when bag 10 is in an upright, resting position. In a resting position, wheeled carrying bag 10 is supported by wheel assemblies 20 and bottom stand 25, which is attached to molded base 19.

Figure 5:
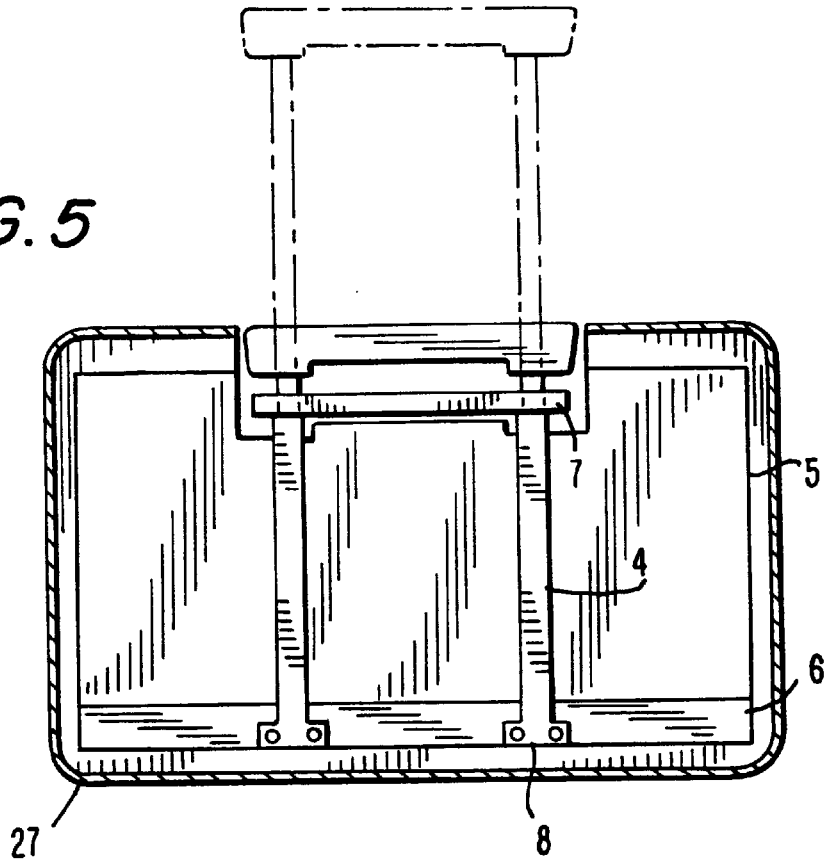
FIG. 5 is a rear elevational view of the handle assembly and well constructed in accordance with invention.
Figure 6:
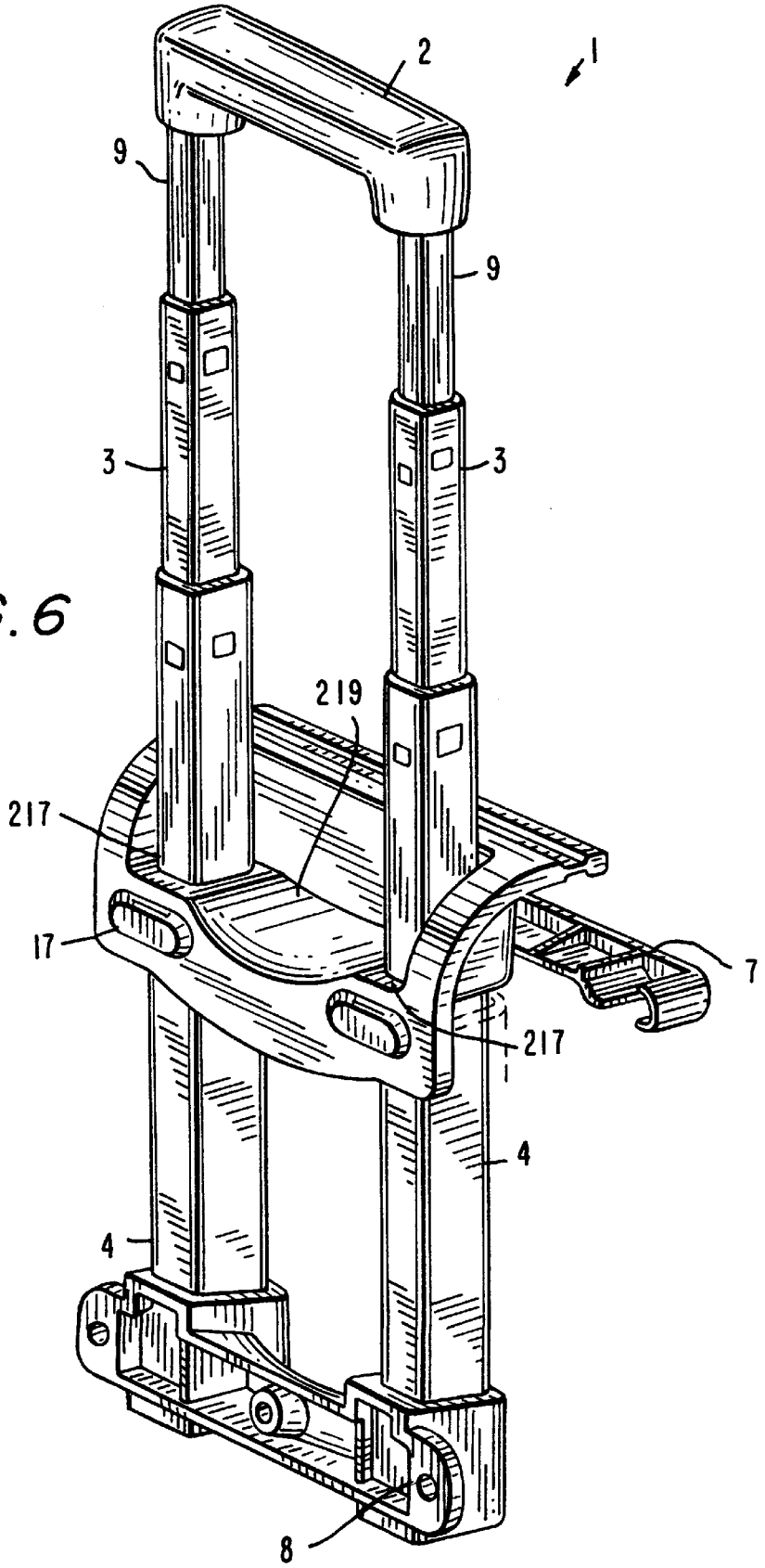
FIG. 6 is an exploded perspective view of the handle assembly constructed in accordance with the invention.

Reference is now made to FIGS. 5 and 6 which show handle assembly 1 in greater detail. Handle assembly 1 includes a first support 5, a second support 6 and a retractable handle. The retractable handle includes a grip 2 connected to handle rods 3, which are slidably received within outer sleeves 4. A molded frame 17 is disposed about outer sleeves 4. In a preferred embodiment, handle rods 3 are made of square tubings which provide for stronger handle rods as compared to rods which are made of round tubings. In another preferred embodiment handle assembly 1 may include additional inner handle rods 9 which are slidably received within handle rods 3. Handle assembly 1 is partially contained within a second well 27 (FIG. 3), which is formed by side panel 13 and back panel 12. A divider panel 24 separates first well 26 from second well 27. In a preferred embodiment, divider panel 24 may be constructed of two or more panels which may have storage pockets and associated zippers located in the divider panels.

A first support 5, made of a soft semi-rigid, lightweight material such as plastic, rubber, cardboard and the like, is disposed within well 27 adjacent back panel 12 and substantially covers the area of back panel 12. These materials provide structural integrity without providing a hard fixed surface to the user. A second support 6, also made of a lightweight material, such as plastic, rubber, cardboard and the like, but more rigid than first support 5, is mounted in facing relationship with first support 5. Second support 6 is substantially smaller in area than first support 5. Second support 6 extends the length of carrying bag 10 but may be substantially less than one-half the height of first support 5.

In a preferred embodiment, frame 17 is a molded unitary construction. Outer sleeves 4 are anchored at one end by molded frame 17. Outer sleeves 4 extend through openings 217, wherein molded grip 2 fits within molded frame 17. In the preferred embodiment, molded frame 17 has a curved structure when viewed from the side to mimic the transition from back panel 12 to side panel 13. Molded frame 17 fits within opening 200 of back panel 12. As a result, frame 17 is flush with the outer surface of bag 10. The interior of frame 17 forms a tray 219 for receiving handle 2 when handle assembly 1 is in the contracted position, i.e. when handle rods 3 are slid completely within outer sleeves 4. Wheel assemblies 20 help provide anchoring support to maintain first support 5 in place.

Outer sleeves 4 and frame 17 are affixed to back panel 12 within second well 27 by a first attachment member 7, which is affixed to frame 17 by fasteners such as screws or the like. This sandwiches back panel 12, first support 5 and outer sleeves 4 between frame 17 and attachment member 7. Outer sleeves 4 are also attached to back panel 12 within second well 27 along with first support 5 and second support 6 by second attachment member 8. In a preferred embodiment, first attachment member 7 and second attachment member 8 may be formed by a bracket with nuts and bolts. Other attachment mechanisms may include buckles, belts, cords, and the like. This manner of attachment allows for attachment of handle assembly 1 to back panel 12 without having the restriction that back panel 12 be made of a hard, rigid material. First support 5 and second support 6 provide the support for handle assembly 1 which in the prior art was provided directly by back panel 12 or bottom 15. Thus, this attachment structure provides for a lighter handle attachment means and consequently results in a lighter wheeled carrying bag 10. It should be noted that, in this embodiment, outer sleeves 4 extend through frame 17. However, frame 17 may be positioned so that only rods 3 extend through frame 17.

Figure 3:
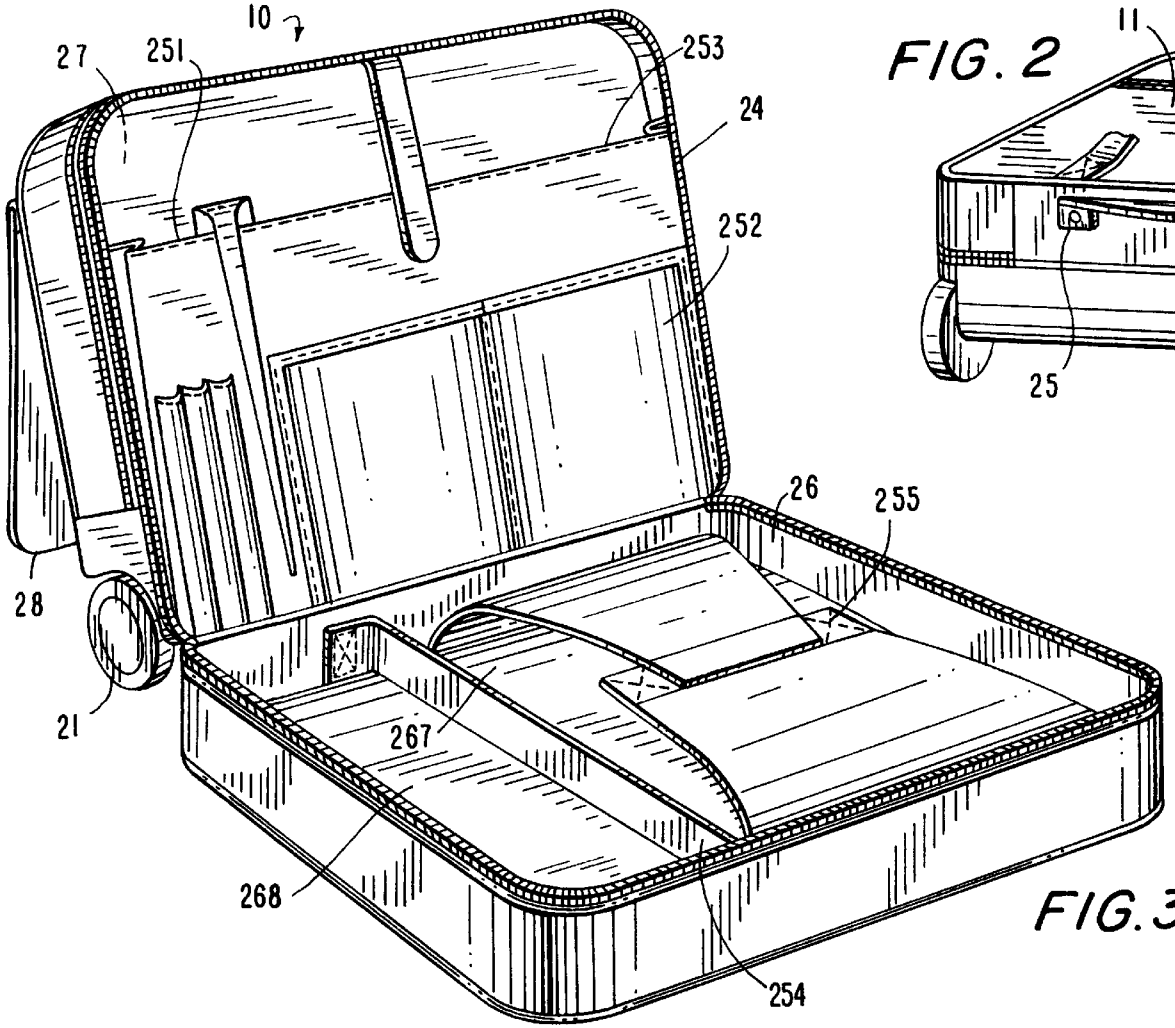
FIG. 3 is a perspective view of the opened wheeled carrying bag constructed in accordance with the invention.

Reference is now made to FIG. 3 which illustrates the interior of wheeled carrying bag 10, constructed in accordance with the invention, with greater particularity. Wheeled carrying bag 10 includes a first well 26 which is divided by a foam divider 254 into a laptop computer receiving portion 267 and a storage portion 268. Retaining straps 255 are affixed within laptop computer receiving portion 267 to retain a laptop computer therein. Foam divider 254 provides additional support for the laptop computer. In a preferred embodiment, the depth of first well 26 may be three and one-half inches. Wheeled carrying bag 10 may also include a covering flap 28 which has a hand carrying handle attached to it. The hand carrying handle may be made of leather, molded plastic or the like.

Well 27 includes a divider panel 24, which is co-extensive with well 27 and shields well 26 from handle assembly 1. A telephone pocket 251 for storing a cellular phone, a disk pocket 252 for storing computer floppy diskettes and a folder pocket 253 for storing folders and papers can all be formed on divider 24. Carrying bag 10 may contain other similar storage pockets for storing pens, pencils and the like. These pockets may be closed with zippers, or the like.

During use, flaps 255 are separated and a computer may be placed within receiving portion 267 of well 26. Flaps 255 can then be affixed to each other by cords, Velcro®, or the like. The battery or other accessory for the computer may be disposed within received storage portion 268. Well 26 is rotated towards well 27 and the bag is closed. Cover flap 28 is then pivoted and secured so as to cover front panel 11. Grip 2 is now exposed through opening 200 and cover flap 28. The user then grips handle 2 to extend grip 2 from handle rods 3. Further pulling of the grip extends handle rods 3 from outer sleeves 4. The bag is then tilted and can be wheeled to its destination.

Conversely, by pushing down on handle 2, each of the rods 3 and sleeves 4 become retracted so as to provide an unobtrusive smooth exterior. For occasions, such as on an airplane when wheeling is not possible, the bag may be gripped by the hand carrying handle provided on the top of cover flap 28 for carry-on mode.

Figure 4:
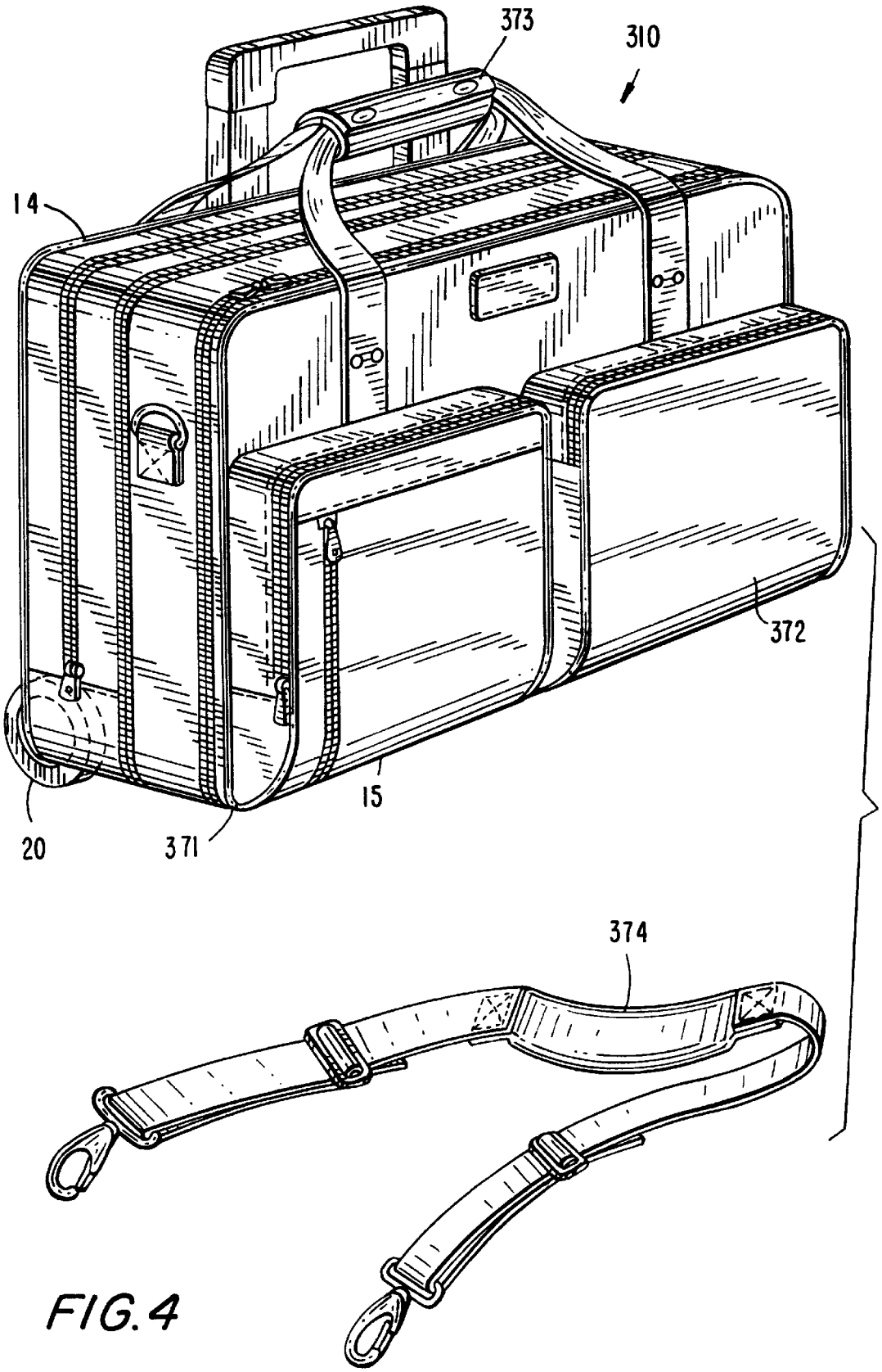
FIG. 4 is a front perspective view of the wheeled carrying bag constructed in accordance with a second embodiment of the invention.

Reference is now made to FIG. 4 which illustrates a wheeled carrying bag generally indicated as 310, constructed in accordance with another embodiment of the invention. Like structure is indicated by like numbers. Wheeled carrying bag 310 includes corner protectors 371 mounted at the junction between front panel 11 and bottom 15. Corner protectors 371 serve to protect the bag from damage due to bumps with walls and the like. Outer pockets 372 mounted on front panel 11 provide extra storage space for wheeled carrying bag 310. Wheeled carrying bag 310 also includes a carrying hand strap 373 for carrying wheeled bag 310 in the arm of the user in a non-wheeled manner. Carrying bag 310 also includes a detachable shoulder strap 374 for carrying wheeled bag 310 on the shoulder of the user. In a preferred embodiment, the height of the bag from top 14 to bottom 15 may be thirteen inches. In another preferred embodiment, the length of the bottom 15 may be sixteen inches and the width of carrying bag 310 may be three inches. In yet another preferred embodiment of wheeled carrying bag 310, piping may be added to the exterior of the bag to provide extra stability and support.

By providing a soft bodied wheeled carrying bag with extra wide wheels and a retractable handle which is attached to light supports and the soft back panel, a lighter, more stable wheeled carrying bag is provided. The light weight of supports 5 and 6 reduce the overall weight of wheeled carrying bag 10. By providing for wheels on the side of wheeled carrying bag 10, the invention provides for a more stable carrying bag 10 when it is used in the wheeled position or when it is used in an upright standing position. By providing for a flexible molded frame which contains the handle grip 2 when the handle is in the retracted, non-wheeling position, the weight of carrying bag 10 is further reduced due to the light material used in the manufacture of frame 17. Moreover, molded frame 17 is shaped to be flush with the bag and, therefore, does not cause any obstruction when carrying bag 10 is being carried in the non-wheeled mode. Also, the flush nature of the molded frame adds to the aesthetics of the bag. By providing for an inner well that can safely contain a laptop computer, the invention meets the ever-growing demand for a light, soft-bodied, wheeled computer carrying bag. Wheeled carrying bag 10 may contain other additional pockets, both externally on front panel 11, back panel 12 or side panel 13, as well as within wheeled carrying bag 10 in either first well 26 or second well 27. Wheeled carrying bag 10 may also contain additional zippers, or the like. Additional pockets, straps and the like may also be included both on the inside and outside of wheeled carrying bag 10.

It will thus be seen that the objects set forth above, and those made apparent from the preceding description, are efficiently obtained and, since certain changes may be made in the above construction without departing from the spirit and scope of the invention, it is intended that all matter contained in the above description or shown in the accompanying drawings, shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A wheeled carrying bag comprising:

a soft front panel;

a soft back panel;

a bottom, said bottom including a molded base affixed to said bottom, said soft back panel and said soft front panel being affixed to said bottom;

a soft side panel affixed to said front panel and said back panel;

at least a first wheel and a second wheel affixed to said bottom, at least a first wheel assembly and a second wheel assembly formed in said molded base, wherein each said wheel assembly includes a wheel cover within a respective wheel assembly, each said wheel cover includes a shaft, said wheel being connected to said wheel cover by said respective shaft, the bottom having a length wherein said first wheel and said second wheel are separated by a distance greater than the length or the bottom; and a handle assembly mounted on said back panel.

2. The wheeled carrying bag of claim 1, further comprising:

a well formed by said back panel and said side panel; and wherein said handle assembly includes a first support disposed within said well, a second support affixed to said first support, a retractable handle being connected to said second support and said first support to affix said retractable handle to said back panel.

3. The wheeled carrying bag of claim 2, further comprising a second well wherein at least one of said first well and said second well is adapted to receive a computer therein.

4. The wheeled carrying bag of claim 2, wherein said handle assembly includes a frame, said frame being affixed to said back panel.

5. The wheeled carrying bag of claim 4, wherein said frame is molded and unitary.

6. The wheeled carrying bag of claim 2, wherein said retractable handle includes a grip, a first handle rod and a second handle rod, said grip being connected to said first handle rod and said second handle rod, a first outer sleeve and a second outer sleeve disposed within said well, each said outer sleeve slidably receiving a respective one of said handle rods such that said handle is slidably movable between an extended position and a retracted position.

7. The wheeled carrying bag of claim 6, wherein said first and second outer sleeves are affixed to said back panel by a first attachment member disposed within said second well, said outer sleeve also being affixed to said back panel, said first support and said second support by a second attachment member disposed within said second well.

8. The wheeled carrying bag of claim 6, wherein each of said outer sleeve and said handle rod defines sleeves that are square-shaped.

9. The wheeled carrying bag of claim 6, further comprising a covering flap, said covering flap being affixed at one end to said back panel.

10. The wheeled carrying bag of claim 9, wherein said covering flap includes an opening to allow said handle rods to pass through said covering flap.

11. A wheeled carrying bag comprising:

a soft front panel;

a soft back panel;

a bottom, said soft back panel and said soft front panel being affixed to said bottom;

a soft side panel affixed to said front panel and said back panel;

at least a first wheel and a second wheel affixed to said bottom;

a well formed by said back panel and said side panel; and a handle assembly mounted on said back panel wherein said handle assembly includes a first support disposed within said well, said first support being made of a soft semi rigid, lightweight material, a second support affixed to said first support, a retractable handle being connected to said second support and said first support to affix said retractable handle to said back panel.

12. The wheeled carrying bag of claim 11, wherein said bottom has a length wherein said first wheel and said second wheel are separated by a distance greater than the length of the bottom.

13. The wheeled carrying bag of claim 11, further comprising a second well wherein at least one of said first well and said second well is adapted to receive a computer therein.

14. The wheeled carrying bag of claim 11, wherein said first support has a first area, said back panel has a second area, said first area being substantially coextensive with said second area.

15. The wheeled carrying bag of claim 14, wherein said second support has a third area, said third area being substantially less than said first area.

16. The wheeled carrying bag of claim 11, wherein said first support has a first height, said second support has a second height, said second height being less than half said first height.

17. The wheeled carrying bag of claim 11, wherein said second support is more rigid than said first support.

18. The wheeled carrying bag of claim 11, further comprising a first attachment member disposed within said well and a frame, said handle assembly being affixed to said back panel by said first attachment member and said frame.

19. The wheeled carrying bag of claim 18, wherein said retractable handle includes a grip and said frame includes a third well, said third well being capable of receiving said grip.

20. The wheeled carrying bag of claim 18, wherein said frame conforms to the shape of said back panel.

* * * * *